US008532535B2

(12) United States Patent
Nose et al.

(10) Patent No.: US 8,532,535 B2
(45) Date of Patent: Sep. 10, 2013

(54) CHARGING MEMBER, MANUFACTURING METHOD FOR CHARGING MEMBER, AND ELECTROPHOTOGRAPHIC APPARATUS

(71) Applicant: Canon Kabushiki Kaisha, Tokyo (JP)

(72) Inventors: Keiji Nose, Suntou-gun (JP); Masaaki Harada, Yokohama (JP); Hiroaki Watanabe, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/655,258

(22) Filed: Oct. 18, 2012

(65) Prior Publication Data

US 2013/0039677 A1 Feb. 14, 2013

Related U.S. Application Data

(63) Continuation of application No. PCT/JP2012/003901, filed on Jun. 14, 2012.

(30) Foreign Application Priority Data

Jun. 30, 2011 (JP) ..... 2011-146210

(51) Int. Cl.
*G03G 15/02* (2006.01)

(52) U.S. Cl.
USPC ..... 399/176

(58) Field of Classification Search
USPC ..... 399/168, 174, 176
See application file for complete search history.

(56) References Cited

U.S. PATENT DOCUMENTS

| | | | | |
|---|---|---|---|---|
| 7,366,448 | B2 * | 4/2008 | Taniguchi et al. | 399/176 |
| 7,486,911 | B2 | 2/2009 | Harada | |
| 8,090,298 | B2 * | 1/2012 | Hoshio et al. | 399/176 |
| 2011/0176833 | A1 | 7/2011 | Harada et al. | |
| 2012/0045250 | A1 | 2/2012 | Harada et al. | |
| 2012/0076539 | A1 | 3/2012 | Sato et al. | |

(Continued)

FOREIGN PATENT DOCUMENTS

| | | | |
|---|---|---|---|
| JP | 9-160355 | A | 6/1997 |
| JP | 2003-228213 | A | 8/2003 |

(Continued)

OTHER PUBLICATIONS

PCT International Search Report and Written Opinion of the International Searching Authority, International Application No. PCT/JP2012/003901, Mailing Date Jul. 10, 2012.
Harada, et al., U.S. Appl. No. 13/695,781, filed Nov. 1, 2012.

*Primary Examiner* — Hoang Ngo
(74) *Attorney, Agent, or Firm* — Fitzpatrick, Cella, Harper and Scinto

(57) ABSTRACT

Provided is a charging member which hardly causes a cleaning failure in a photosensitive member while having such flexibility that a sufficient nip width can be formed with respect to a photosensitive member. The charging member comprises: an electro-conductive support; and an elastic layer as a surface layer, wherein: the elastic layer has a hardened region formed by irradiation with an electron beam; and the hardened region supports a composite particle in a state in which the composite particle is exposed on the surface of the elastic layer, thereby roughening the surface of the elastic layer, and wherein: said composite particle includes a silica-containing porous particle whose surface is coated with a carbon-containing film.

14 Claims, 3 Drawing Sheets

(56) References Cited

U.S. PATENT DOCUMENTS

| | | | |
|---|---|---|---|
| 2012/0082852 | A1 | 4/2012 | Nose et al. |
| 2012/0141161 | A1 | 6/2012 | Watanabe et al. |
| 2012/0177408 | A1 | 7/2012 | Watanabe et al. |
| 2012/0224887 | A1 | 9/2012 | Harada et al. |

FOREIGN PATENT DOCUMENTS

| | | | |
|---|---|---|---|
| JP | 2008-276023 | A | 11/2008 |
| JP | 2010-76205 | A | 4/2010 |
| JP | 2010-256617 | A | 11/2010 |
| JP | 2011-107635 | A | 6/2011 |

* cited by examiner

CHARGING MEMBER, MANUFACTURING METHOD FOR CHARGING MEMBER, AND ELECTROPHOTOGRAPHIC APPARATUS

CROSS-REFERENCE TO RELATED APPLICATIONS

This application is a continuation of International Application No. PCT/JP2012/003901, filed Jun. 14, 2012, which claims the benefit of Japanese Patent Application No. 2011-146210, filed Jun. 30, 2011.

BACKGROUND OF THE INVENTION

1. Field of the Invention

The present invention relates to a charging member to be used in an electrophotographic apparatus or the like, and to an electrophotographic apparatus.

2. Related Background Art

A charging member to be used in contact charging of an object to be charged such as a photosensitive member is generally provided with an elastic layer containing a rubber, a thermoplastic elastomer, or the like in order to ensure a uniform nip with the object to be charged and to prevent the object to be charged from being damaged. However, toner or an external additive is liable to adhere to a surface of such elastic layer. Further, when the elastic layer and the photosensitive member abut on each other in a resting state over a long period of time, permanent deformation may occur in the abutment portion of the elastic layer. To cope with such problem, Japanese Patent Application Laid-Open No. H09-160355 discloses a charging member including a surface-modified layer formed by subjecting a surface of an elastic layer to irradiation with an energy ray such as a UV ray or an electron beam.

SUMMARY OF THE INVENTION

However, as a result of examination on the charging member according to Japanese Patent Application Laid-Open No. H09-160355 above, a cleaning failure occurred in the photosensitive member in some cases. That is, the cleaning failure occurring in the photosensitive member refers to such a phenomenon that residual toner on a surface of the photosensitive member, which should be essentially removed by an elastic blade, is not removed by the elastic blade, resulting in deterioration in quality of an electrophotographic image formed through the subsequent electrophotographic image forming cycle.

In view of the foregoing, the present invention is directed to providing a charging member which hardly causes a cleaning failure in a photosensitive member while having such flexibility that a sufficient nip width can be formed with respect to the photosensitive member, and a manufacturing method therefor. Further, the present invention is directed to providing an electrophotographic apparatus capable of stably forming a high-quality electrophotographic image.

According to one aspect of the present invention, there is provided a charging member, comprising: an electro-conductive support; and an elastic layer as a surface layer, wherein: the elastic layer has a hardened region formed by irradiation with an electron beam; and the hardened region supports a composite particle in a state in which the composite particle is exposed on the surface of the elastic layer, thereby roughening the surface of the elastic layer, and the composite particle includes a silica-containing porous particle whose surface is coated with a carbon-containing film. According to another aspect of the present invention, there is provided an electrophotographic apparatus, comprising: the above-described charging member; and a photosensitive member.

According to further aspect of the present invention, there is provided a manufacturing method for a charging member, the charging member comprising an electro-conductive support, and an elastic layer as a surface layer, the elastic layer having a hardened region formed by irradiation with an electron beam, the hardened region supporting a composite particle in a state in which the composite particle is exposed on the surface of the elastic layer, thereby roughening the surface of the elastic layer, and the composite particle including a silica-containing porous particle whose surface is coated with a carbon-containing film, the method comprising the steps of: (1) forming a rubber layer containing the composite particle on the support; (2) grinding a surface of the rubber layer to expose part of the composite particle; and (3) hardening the surface of the rubber layer to form the elastic layer by subjecting the surface of the rubber layer, on which the part of the composite particle is exposed, obtained in the step (2) to irradiation with an electron beam.

According to the present invention, there is provided the charging member which suppresses the occurrence of a cleaning failure while having such flexibility that a sufficient nip width can be formed with respect to the photosensitive member, and the manufacturing method therefor.

Further features of the present invention will become apparent from the following description of exemplary embodiments with reference to the attached drawings.

DESCRIPTION OF THE EMBODIMENTS

The inventors of the present invention have made extensive studies on a cause for the occurrence of the cleaning failure in the charging member according to Japanese Patent Application Laid-Open No. H09-160355 above. As a result, the inventors have estimated a mechanism for the occurrence as follows.

Figure 2:
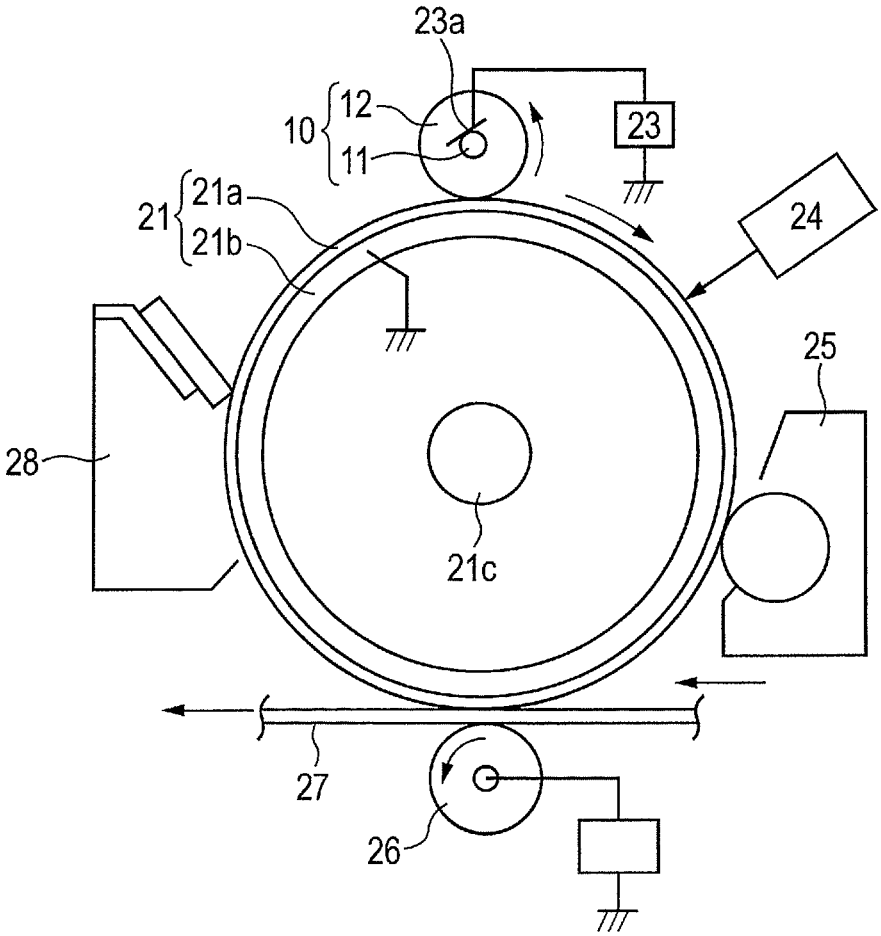
FIG. 2 is a diagram illustrating a schematic configuration example of an electrophotographic apparatus including a charging member.

FIG. 2 illustrates a schematic configuration example of an electrophotographic apparatus including a charging roller as a charging member. An electrophotographic photosensitive member (hereinafter, abbreviated as "photosensitive member") 21 as an object to be charged includes an electro-conductive support 21*b* and a photosensitive layer 21*a* formed on the support 21*b* and has a drum shape. In addition, the photosensitive member is rotationally driven around a shaft 21*c* at the center at a predetermined peripheral speed in a clockwise direction in the figure. A charging roller 10 is placed so as to be brought into contact with the photosensitive member 21 and charges the photosensitive member with a predetermined polarity and potential (primary charging). The charging roller 10 includes a mandrel 11 and an elastic layer 12 formed on the mandrel 11, is pressed against the photosensitive member 21 by pressing unit (not shown) at both end portions of the mandrel 11, and rotates in accordance with the rotational driving of the photosensitive member 21. The photosensitive member 21 is subjected to contact charging with a predetermined polarity and potential by applying a predetermined direct current (DC) bias of the mandrel 11 with a rubbing power source 23*a* connected to a power source 23. The photosensitive member 21 whose circumferential surface has been charged with the charging roller 10 then receives an exposure of image information of interest (e.g., a laser beam scanning exposure or a slit exposure of a document image) by exposing unit 24. Thus, electrostatic latent images corresponding to the image information of interest are formed on the circumferential surface. The electrostatic latent images are then sequentially developed into visible images as toner images by a developing member 25. The toner images are then sequentially transferred by transferring unit 26 onto a transfer material 27 taken out of a paper-feeding unit portion (not shown) in synchronization with the rotation of the photosensitive member 21 to be conveyed to a transfer portion between the photosensitive member 21 and the transferring unit 26 at an appropriate timing.

The transferring unit 26 in FIG. 2 is a transferring roller, and the toner images on the photosensitive member 21 side are transferred onto the transfer material 27 by charging with a polarity opposite to that of the toner from the back of the transfer material 27. The transfer material 27 of which the toner images have been transferred on its surface is separated from the photosensitive member 21, conveyed to fixing unit (not shown) where the images are fixed, and output as an image-formed product. Alternatively, the transfer material of which the images are to be formed on the reverse surface as well is conveyed to reconveying unit (not shown) to the transfer portion. The circumferential surface of the photosensitive member 21 after image transfer is cleaned by removing an adhering contaminant such as transfer residual toner by a cleaning member (elastic blade) 28. The photosensitive member 21 whose surface has been cleaned is subjected to electrophotographic image forming processes as the subsequent cycle.

In a series of the electrophotographic image forming processes, the charging roller discharges in a gap near a nip with the photosensitive member, thereby charging the surface of the photosensitive member. In that case, a corona product to be generated in the vicinity of the charging roller, abrasion powder on the surface of the photosensitive member, and the like adhere to the surface of the photosensitive member. Then, they are accumulated on the surface of the photosensitive member by being pressed against the surface of the photosensitive member at the nip between the charging roller and the photosensitive member.

Then, a friction coefficient between the photosensitive member and the elastic blade gradually increases. After the lapse of a certain time, the elastic blade starts to vibrate owing to a high friction coefficient between the photosensitive member and the elastic blade, which makes it difficult to sufficiently remove the residual toner on the surface of the photosensitive member. As a result, the photosensitive member of which the residual toner has adhered to its surface is subjected to the electrophotographic image forming processes as the subsequent cycle.

In this case, an increase in the friction coefficient between the photosensitive member and the elastic blade remarkably appeared in a charging roller including an elastic layer as a surface layer. The reason for this is probably that the charging roller including an elastic layer as a surface layer has a flexible surface, and hence a contact surface area in a nip portion between the charging roller and the photosensitive member increases, with the result that a substance causing an increase in friction coefficient (hereinafter, also referred to as "friction coefficient increasing substance") such as a corona product is liable to stick to the surface of the photosensitive member.

In view of the foregoing, the inventors of the present invention have made various studies in order to provide a charging member which hardly causes the sticking of the corona product to the surface of the photosensitive member while having flexibility for providing an appropriate nip with the photosensitive member.

As a result, the inventors have found that the object can be achieved by a charging member including as a surface layer an elastic layer having such a configuration that the elastic layer has a hardened region formed by irradiation with an electron beam in its surface, the hardened region supports composite particles including silica-containing porous particles whose surface is coated with a carbon-containing film in a state in which at least part of the composite particles is exposed on the surface of the elastic layer, and the composite particles roughen the surface of the elastic layer.

Embodiments of the charging member according to the present invention are described below.

<Charging Member>

The charging member according to the present invention includes an electro-conductive support, and an elastic layer as a surface layer. Further, a surface of the elastic layer is roughened by composite particles including silica-containing porous particles whose surface is coated with a carbon-containing film. Further, the elastic layer has a hardened region formed by irradiation with an electron beam in its surface. In addition, at least part of the composite particles is supported by the hardened region in a state in which part of each of the particles (hereinafter, simply referred to as part of the composite particles) is exposed on the surface of the elastic layer.

The shape of the charging member may be appropriately selected and may be a roller shape, a blade shape, or the like. Herein, a description is made focusing on a roller-shaped charging roller.

It should be noted that the hardened region may be formed on the entire surface of the elastic layer, and when the charging member of the present invention is, for example, a charging roller, the hardened region may be formed on the entire outer circumferential surface of the elastic layer.

Figure 1:
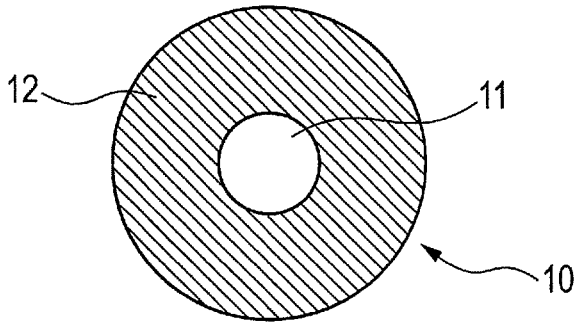
FIG. 1 is a schematic cross-sectional diagram illustrating a configuration example of a charging roller.

FIG. 1 is a schematic cross-sectional diagram of a roller-shaped charging member (hereinafter, abbreviated as "charging roller") 10 according to the present invention. The charging roller 10 includes a mandrel 11 as an electro-conductive support and an elastic layer 12 formed on the mandrel 11. The charging member of the present invention may be used as a charging member for an electrophotographic apparatus, for example, the charging roller 10 for an electrophotographic apparatus illustrated in FIG. 2 or the like.

Figure 3A:
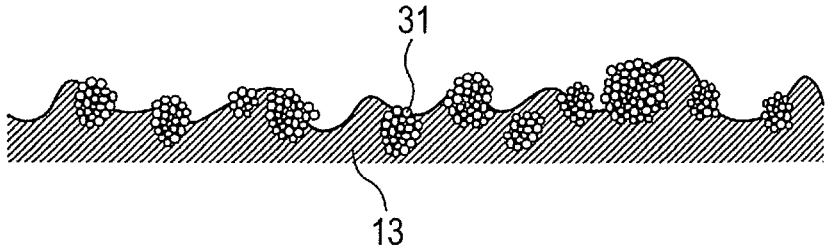
FIG. 3A is a schematic cross-sectional diagram illustrating examples of a surface profile of a charging member of the present invention.
Figure 3B:
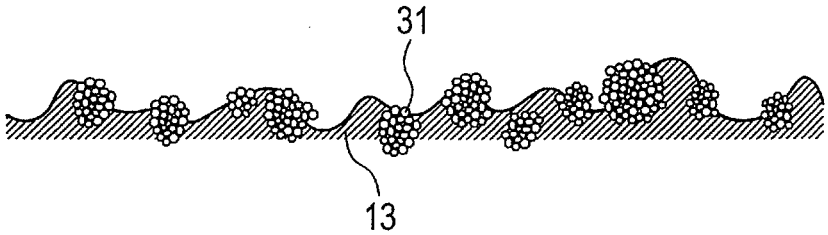
FIG. 3B is a schematic cross-sectional diagram illustrating examples of the surface profile of the charging member of the present invention.

FIGS. 3A and 3B are schematic diagrams illustrating surface profiles of the charging member of the present invention. The elastic layer of the charging member in the present invention contains composite particles 31 including silica-containing porous particles whose surface is coated with a carbon-containing film, and the composite particles 31 roughen the surface of the elastic layer. Further, the surface of the elastic layer is subjected to a hardening treatment by irradiation with an electron beam, and part of the composite particles 31 is exposed on the surface of the elastic layer and supported by a hardened region 13 in the elastic layer.

The composite particles 31 are supported by the hardened region 13. Hence, even when the elastic layer abuts on an object to be charged such as a photosensitive member, no burying of the composite particles in the elastic layer occurs at the nip therebetween.

The composite particles 31 have high affinity with the elastic layer because the surface of the composite particles are coated with the carbon-containing film, and moreover, are easily retained on the surface of the charging roller because a rubber component in the elastic layer enters pores derived from the porous particles. This allows the particles to be prevented from being detached from the surface of the charging roller, even when a friction occurs between the object to be charged such as the photosensitive member and the charging member during the use of the charging member in an electrophotographic apparatus. Further, the composite particles 31 contain silica inside the particles and thus are hard particles. Hence, in a grinding step using grindstone or the like, the particles themselves are hardly ground and thus can be present on the surface of the rubber layer (elastic layer).

Consequently, the composite particles 31 can maintain surface irregularities in a state in which part of the composite particles is exposed on the surface of the elastic layer, and can reduce a contact surface area with the photosensitive member. This makes it difficult for the friction coefficient increasing substance to stick to the surface of the elastic layer, which can contribute to an improvement in cleaning failure.

It should be noted that, in the charging member of the present invention, all the composite particles may expose part thereof on the surface of the elastic layer. Alternatively, as illustrated in FIGS. 3A and 3B, composite particles constituting part of all the composite particles 31 may expose part thereof on the surface of the elastic layer, and composite particles whose entire surface is contained in the elastic layer may be present.

(Electro-Conductive Support)

The electro-conductive support supports an elastic layer (in general, an electro-conductive elastic layer) to be provided thereon, and an electro-conductive support appropriately selected from members known in the electrophotographic apparatus field capable of conducting a current required upon charging may be used. A material for the electro-conductive support is exemplified by metals such as iron, aluminum, titanium, copper, and nickel, and alloys including those metals, such as carbon steel, stainless steel, duralumin, brass, and bronze.

(Elastic Layer)

The elastic layer may contain a base polymer and a cross-linked product thereof, and composite particles including silica-containing porous particles whose surface is coated with a carbon-containing film. As the base polymer, there is used a material capable of imparting rubber elasticity to the elastic layer in the actual use temperature range of the charging member. Examples of the base polymer include a thermoplastic elastomer and a thermosetting rubber.

The thermosetting rubber may be a rubber composition obtained by compounding a cross-linking agent into a raw material rubber. Herein, specific examples of the raw material rubber include natural rubber (NR), isoprene rubber (IR), butadiene rubber (BR), styrene-butadiene rubber (SBR), butyl rubber (isobutylene-isoprene rubber: IIR), ethylene-propylene-diene terpolymer rubber (EPDM), an epichlorohydrin homopolymer (CHC), an epichlorohydrin-ethylene oxide copolymer (CHR), an epichlorohydrin-ethylene oxide-allyl glycidyl ether terpolymer (CHR-AGE), an acrylonitrile-butadiene copolymer (NBR), a hydrogenated acrylonitrile-butadiene copolymer (H-NBR), chloroprene rubber (CR), and acrylic rubber (ACM, ANM).

Further, specific examples of the thermoplastic elastomer include thermoplastic elastomers such as a thermoplastic polyolefin-based thermoplastic elastomer, a polystyrene-based thermoplastic elastomer, a polyester-based thermoplastic elastomer, a polyurethane-based thermoplastic elastomer, a polyamide-based thermoplastic elastomer, and a vinyl chloride-based thermoplastic elastomer.

Further, examples of the cross-linking agent may include sulfur, dicumyl peroxide, p-benzoquinone dioxime, and p,p'-dibenzoquinone dioxime.

Moreover, the elastic layer may contain an electro-conductive agent, a filler, a processing aid, an antioxidant, a cross-linking aid, a cross-linking accelerator, a cross-linking supplement accelerator, a cross-linking retarder, and a dispersant.

Unless otherwise stated, the elastic layer as used herein means an elastic layer as a surface layer (sometimes referred to as surface elastic layer). In the present invention, the surface elastic layer may be formed directly on the electro-conductive support. Alternatively, any other layer (e.g., an adhesion layer) may be formed between the electro-conductive support and the surface elastic layer.

Further, the elastic layer may also be formed of a plurality of layers (have one or more elastic layers in addition to a surface elastic layer). In this regard, however, when the elastic layer is formed of a plurality of layers, it is necessary to form, on the outermost surface, a layer containing composite particles including porous particles whose surface is coated with a carbon-containing film (surface elastic layer). Further, when the elastic layer is formed of a plurality of layers, in a method involving extrusion into a tube shape or a method involving extrusion using a cross head to be described later, it is preferred to simultaneously form the respective layers through the use of a multilayer extruder. In the present invention, it is most preferred that the elastic layer be formed of a single layer (only the surface elastic layer) in order to maximize an effect of simplifying production steps.

Examples of the composite particles to be contained in the elastic layer may include silica ($SiO_2$)-containing porous particles whose surface is entirely and partially coated with a carbon-containing film. The silica-containing porous particles have only to be particles having a porous structure and containing silica, and there may be used, for example, a product obtained by appropriately pulverizing rice hulls or defatted rice bran remaining after the oil expression of rice bran oil, or porous silica particles. When the rice hulls or the defatted rice bran, which has a porous structure and contains silica in a large amount, is burned at an appropriate temperature, the content ratio of silica can exceed 90 mass %. It should be noted that a single kind of the silica-containing porous particles or the composite particles may be used alone, or two or more kinds thereof may be used in combination.

Further, the porous particle may be composed only of silica, or may include $K_2O$, $Na_2O$, CaO, MgO, or $Fe_2O_3$ in addition to silica.

It should be noted that the content of silica in the porous particles is set to preferably 80 mass % or more, more preferably 95 mass % or more from the viewpoint of the hardness of the particles. The content of silica in the porous particles may be identified by inductively coupled plasma (ICP) optical emission spectroscopy.

The carbon-containing film may be a carbonized film obtained by carbonizing an organic substance (e.g., a thermosetting resin, sugars such as sucrose, or bitumens such as coal pitch). It should be noted that the content of a carbon atom in the film is set to preferably 50 mass % or more, more preferably 90 mass % or more from the viewpoint of affinity with the elastic layer. The content of carbon in the film may be identified by energy dispersive fluorescent X-ray analysis apparatus (EDX) analysis.

It should be noted that the carbon-containing film may be composed only of carbon, or may include an element other than carbon, such as nitrogen, oxygen, silicon, sulfur, hydrogen, sodium, potassium, chlorine, bromine, phosphorus, or magnesium.

Further, the thickness of the carbon-containing film is preferably 50 nm or more from the viewpoint of affinity with the elastic layer and 10 μm or less from the viewpoint of keeping a pore shape. The thickness of this film may be identified by transmission electron microscope (TEM) observation.

In the present invention, the composite particles may be formed, for example, by mixing a thermosetting resin and silica-containing porous particles and calcining the mixture. That is, the composite particles may be particles obtained by coating the surface of porous silica particles or the surface of pulverized rice hulls or defatted rice bran with a thermosetting resin, followed by calcining, that is, particles including silica-containing porous particles whose entire surface is coated with a carbonized resin film. Examples of the thermosetting resin may include a phenolic resin.

A production method for the composite particles is specifically described below.

To a raw material (porous particles: e.g., pulverized rice hulls or defatted rice bran powder passed through a mesh sieve) is added a thermosetting resin such as a phenolic resin at a ratio of 5 to 50 mass % with respect to the total mass of the raw material and the thermosetting resin, followed by mixing. In the step of mixing the thermosetting resin, a paste is prepared by adding an appropriate amount of water or adding an aqueous solution mixed with an appropriate amount of a binder such as a seaweed glue or starch, in parallel with the commingling of the raw material with the thermosetting resin. After the mixing of the thermosetting resin with the raw material, while the resultant is being granulated through the use of a known granulator such as a drum-type granulator, the temperature is increased to 60 to 80° C. to remove volatile components and then dry. The resultant granulated product is passed through a 5-mesh sieve to obtain a particulate mixture.

After that, the temperature is increased to 800 to 1,400° C., and the particulate mixture is calcined and carbonized in inert gas to obtain a calcined product. The resultant calcined product is pulverized and then subjected to a sieve and a classifier so as to have a desired particle diameter, to thereby obtain composite particles including porous silica particles whose surface is coated with carbon.

A pulverizer is exemplified by: Counter Jet Mill, Micron Jet, and Inomizer (all of which are trade names, manufactured by Hosokawa Micron); IDS-type Mill and PJM Jet pulverizer (trade names, manufactured by Nippon Pneumatic Mfg Co., Ltd.); Cross Jet Mill (trade name, manufactured by Kurimoto Tekkosho KK); Ulmax (trade name, manufactured by Nisso Engineering Co., Ltd.); SK Jet O-Mill (trade name, manufactured by Seishin Enterprise Co., Ltd.); Criptron (trade name, manufactured by Kawasaki Heavy Industries, Ltd.); Turbo Mill (trade name, manufactured by Turbo Kogyo Co., Ltd.); and Super Rotor (trade name, manufactured by Nisshin Engineering Inc.).

Examples of the classifier include: Classiel, Micron Classifier, and Spedic Classifier (all of which are trade names, manufactured by Seishin Enterprise Co., Ltd.); Turbo Classifier (trade name, manufactured by Nisshin Engineering Inc.); Micron Separator, Turboprex (all of which are trade names, ATP), and TSP Separator (trade name, manufactured by Hosokawa Micron); Elbow Jet (trade name, manufactured by Nittetsu Mining Co., Ltd.); Dispersion Separator (trade name, manufactured by Nippon Pneumatic Mfg Co., Ltd.); and YM Microcut (trade name, manufactured by Yasukawa Shoji K.K.).

A sieving apparatus for sieving coarse particles and the like is exemplified by Ultra Sonic (trade name, manufactured by Koei Sangyo Co., Ltd.); Rezona Sieve and Gyro Sifter (both of which are trade names, manufactured by Tokuju Corporation); Vibrasonic System (trade name, manufactured by Dalton Co., Ltd.); Sonicreen (trade name, manufactured by Shinto Kogyo K.K.); Turbo Screener (trade name, manufactured by Turbo Kogyo Co., Ltd.); Microsifter (trade name, manufactured by Makino mfg. co., Ltd.); and circular vibrating sieves.

The structure of the composite particles to be used in the present invention may be confirmed by scanning electron microscope (SEM) observation and energy dispersive fluorescent X-ray analysis apparatus (EDX) analysis.

A specific method therefor is shown below. First, the produced composite particles are subjected to dispersion and embedding treatments in an epoxy resin. Next, through the use of a cryo system (trade name: "REICHERT-NISSEI-FCS," manufactured by Leica), a thin-film specimen is produced with an ultramicrotome (trade name: "EM-ULTRACUT•S" manufactured by Leica) equipped with a diamond knife. At this time, the size of the thin-film specimen is set to 0.2 mm×0.7 mm. After that, the cross-section of the particles is observed by SEM and analyzed by EDX analysis.

Apparatus: 54700 (trade name, manufactured by Hitachi, Ltd.)

Accelerating voltage: 20 kV

Magnification: 5,000 times

When the composite particles produced by the above-mentioned method are subjected to this analysis, it is possible to confirm that the composite particles have a layer containing carbon as a main component on their surfaces and have particles containing silica as a main component in their inner portions (e.g., the central portion of the composite particles).

The pore diameter of the composite particles may be identified by carrying out observation with a scanning electron microscope (trade name: JEOL LV5910 manufactured by JEOL Ltd.), taking an image, and analyzing the taken image through the use of image analysis software (trade name: Image-Pro Plus manufactured by Planetron). In the analysis, the number of pixels per unit length is calibrated from a micron bar at the time of taking an image, and 50 particles selected randomly from the image are measured for their unidirectional particle diameter based on the number of pixels on the image. At this time, all pores which can be confirmed on the taken image in one particle are counted.

The pore diameter of the composite particles is preferably 0.5 μm or more, particularly preferably 1 μm or more. When the pore diameter is 0.5 μm or more, a constituent material such as a base polymer used in the elastic layer enters pores, which facilitates the retention on a roller surface.

The compounding amount of the composite particles in the elastic layer is preferably 1 part by mass or more and 5 parts by mass or less with respect to 100 parts by mass of the base polymer. When the compounding amount is 1 part by mass or more, a contact surface area with a surface of an object to be charged such as a photosensitive member can be easily reduced sufficiently. When the compounding amount is 5 parts by mass or less, an increase in hardness occurs, and the occurrence of an image failure due to the easier adhesion of toner or an external additive to a charging roller surface can be easily suppressed.

The weight average particle diameter of the composite particles to be used in the present invention is preferably 5 μm or more and 70 μm or less. When the weight average particle diameter is 5 μm or more, a contact surface area with a surface of an object to be charged such as a photosensitive member can be easily reduced sufficiently. Further, when the weight average particle diameter is 70 μm or less, an image failure due to scratches on a surface of an object to be charged such as a photosensitive member resulting from the large particle diameter can be easily suppressed.

It should be noted that the weight average particle diameter of the composite particles means the weight average value of circle equivalent diameters measured with a flow-type particle image analyzer "FPIA-3000" (trade name, manufactured by SYSMEX CORPORATION).

A specific measurement method is as described below. First, about 20 ml of ion-exchanged water from which an impure solid and the like have been removed in advance is charged into a container made of glass. About 0.2 ml of a diluted solution prepared by diluting a trade name: "Contaminon N" (a 10-mass % aqueous solution of a neutral detergent for washing a precision measuring unit formed of a nonionic surfactant, an anionic surfactant, and an organic builder and having a pH of 7, manufactured by Wako Pure Chemical Industries, Ltd.) with ion-exchanged water by about three mass fold is added as a dispersant to the container. Further, about 0.02 g of a measurement sample (composite particles) is added to the container, and then the mixture is subjected to a dispersion treatment with an ultrasonic dispersing unit for 2 minutes so that a dispersion solution for measurement may be obtained. At that time, the dispersion solution is appropriately cooled so as to have a temperature of 10° C. or more and 40° C. or less. A desktop ultrasonic cleaning and dispersing unit having an oscillatory frequency of 50 kHz and an electrical output of 150 W (such as a trade name: "VS-150" (manufactured by VELVO-CLEAR)) is used as the ultrasonic dispersing unit. A predetermined amount of ion-exchanged water is charged into a water tank, and about 2 ml of the Contaminon N is added to the water tank.

The flow-type particle image analyzer mounted with a standard objective lens (10 times) is used in the measurement, and a particle sheath "PSE-900A" (trade name, manufactured by SYSMEX CORPORATION) is used as a sheath liquid. The dispersion solution prepared in accordance with the procedure is introduced into the flow-type particle image analyzer, and the particle diameter is measured according to the quantitative count mode of an LPF measurement mode.

On the measurement, automatic focusing is performed with standard latex particles (obtained by diluting, for example, a trade name: "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in examples to be described later, a flow-type particle image analyzer which had been subjected to a calibration operation by SYSMEX CORPORATION and received a calibration certificate issued by SYSMEX CORPORATION was used.

In the present invention, the surface of the elastic layer is roughened by the composite particles. As for the degree of the roughness, the ten-point average roughness Rz of a charging member surface is preferably 3 μm or more and 30 μm or less. When Rz is controlled within the above-mentioned range of numerical values, a reduction in cleaning property and the adhesion of dirt to a surface due to an increase in contact surface area with a photosensitive member can be suppressed more certainly. It should be noted that Rz may be measured based on JIS B0601: 1982.

<Manufacturing Method for Charging Member>

A manufacturing method for a charging member according to the present invention includes the following steps of:

(1) forming, on an electro-conductive support, a rubber layer including composite particles including silica-containing porous particles whose surface is coated with a carbon-containing film;

(2) grinding a surface of the rubber layer to expose part of the composite particles on the surface of the rubber layer; and (3) hardening the surface of the rubber layer to form an elastic layer by subjecting the surface of the rubber layer, on which the part of the composite particles are exposed, obtained in the step (2) to irradiation with the electron beam.

The respective steps are described below.

(Step 1)

First, a rubber layer containing the composite particles is formed on an electro-conductive support. It should be noted that the rubber layer may be a mixture containing the composite particles (which may contain a base polymer, an additive, and the like) formed into a predetermined shape. Specific examples of the step 1 are described below.

First, a mixture containing a base polymer (a thermosetting rubber or a thermoplastic elastomer) constituting an elastic layer and composite particles is prepared. It should be noted that the mixture in the case of using the thermosetting rubber as the base polymer, that is, a pre-vulcanization composition of the thermosetting rubber is hereinafter referred to as unvulcanized rubber composition. Subsequently, the resultant mixture is formed into a predetermined shape on the electro-conductive support and subjected to a cross-linking operation or the like as necessary for solidification, to thereby form a rubber layer. Hereinafter, a roller formed of the thermosetting rubber and obtained by forming the shape before vulcanization is referred to as unvulcanized rubber roller, and a roller formed of the thermosetting rubber after vulcanization is referred to as vulcanized rubber roller.

As a formation method for the rubber roller, the following examples are given: a method involving extrusion-molding a rubber composition into a tube shape with an extruder and inserting a mandrel into the resultant; a method involving co-extruding a rubber composition into a cylindrical shape around the mandrel at the center with an extruder equipped with a cross head, to thereby obtain a molded article having a desired outer diameter; and a method involving injecting a rubber composition into a mold having a desired outer diameter through the use of an injection molding machine to obtain a molded article. Of those, an extrusion molding method using a cross head extruder is most preferred because this method is easily applied to continuous production, has a small number of steps, and is suitable for manufacture at low cost.

When the rubber material (base polymer) is a thermosetting rubber, vulcanization is carried out after molding. The vulcanization is carried out by a heating treatment, and as a heating apparatus, there may be given, for example, hot-air oven heating with a Geer oven, heating vulcanization with far-infrared radiation, and steam heating with a vulcanizer. Of those, hot-air oven heating, far-infrared heating, or the like is preferred because it allows continuous production.

(Step 2)

Subsequently, a surface of the rubber layer in the rubber roller is subjected to a grinding treatment, to thereby expose part of the composite particles on the surface of the rubber layer. The composite particles contain silica inside the particles and thus are hard. Hence, the particles themselves are hardly ground in a grinding step using grindstone or the like, and thus can be present on the surface of the rubber layer. A grinding method for the surface of the rubber roller is exemplified by the following grinding modes: a traverse grinding mode involving grinding with grindstone shifted in a major axis direction of the roller; and a plunge cut grinding mode involving cutting with grindstone wider than the length of the roller while allowing the roller to rotate around a mandrel shaft at the center. A plunge cut cylindrical grinding mode is more preferred because it has an advantage in that the whole width of the rubber roller can be ground at once, and can shorten a processing time as compared to a traverse cylindrical grinding mode.

(Step 3)

Finally, the surface of the rubber layer (rubber roller surface) after grinding is subjected to a surface hardening treatment by irradiation with an electron beam to form an elastic layer having a hardened region in its surface.

Figure 5:
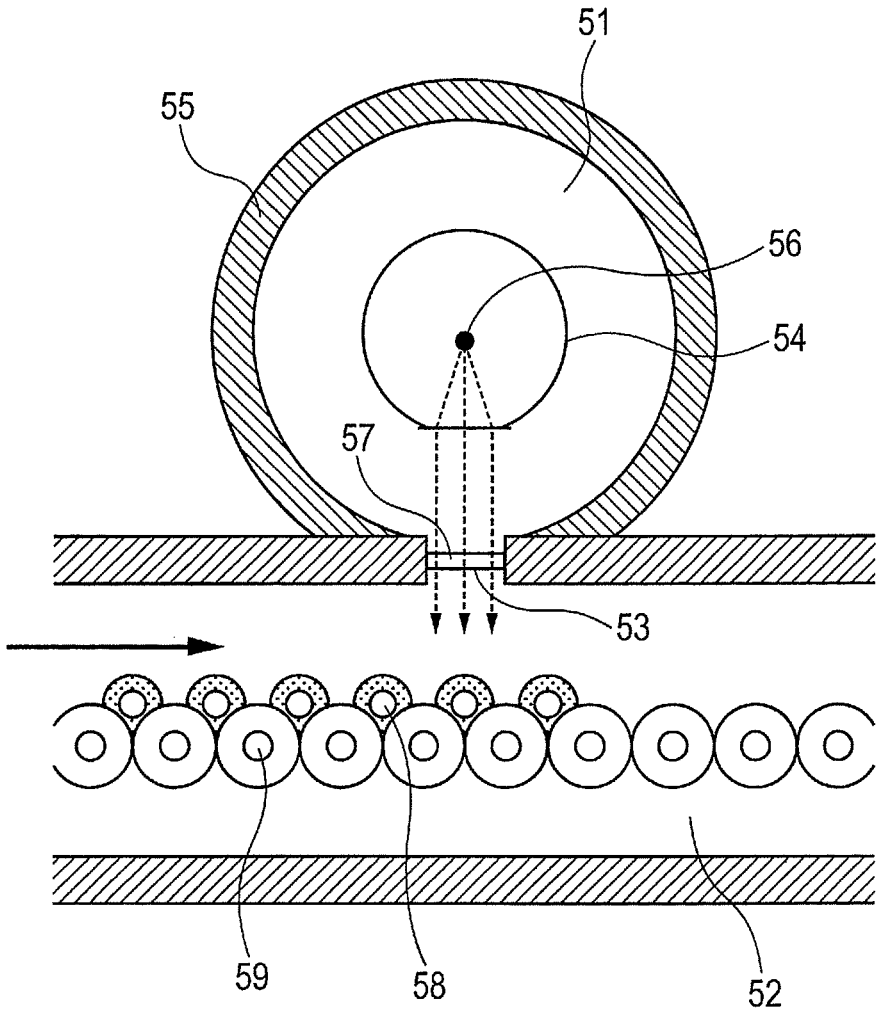
FIG. 5 is a diagram illustrating a schematic configuration example of an electron beam irradiation apparatus.

FIG. 5 illustrates a schematic diagram of an electron beam irradiation apparatus. As the electron beam irradiation apparatus which may be used in the present invention, there may be suitably used an apparatus for irradiating the surface of the roller with an electron beam while allowing the rubber roller after grinding to rotate. For example, as illustrated in FIG. 5, the apparatus includes an electron beam-generating portion 51, an irradiation chamber 52, and an irradiation hole 53.

The electron beam-generating portion 51 has a terminal 54 for generating an electron beam and an accelerating tube 55 for accelerating the electron beam generated in the terminal 54 in a vacuum space (accelerating space). Further, the inside of the electron beam-generating portion is kept at a vacuum of $10^{-3}$ Pa or more and $10^{-6}$ Pa or less with a vacuum pump (not shown) or the like in order to prevent an electron from colliding with a gas molecule to lose energy. When a filament 56 is heated by being applied with a current by a power source (not shown), the filament 56 releases thermoelectrons, and only the thermoelectron that has passed through the terminal 54 is extracted effectively as an electron beam.

Then, the electron beam is accelerated in the accelerating space of the accelerating tube 55 with an accelerating voltage of the electron beam. After that, the electron beam passes through an irradiation hole foil 57 to irradiate a rubber roller 58 after grinding to be conveyed in the irradiation chamber 52 on the lower side of the irradiation hole 53. When the rubber roller 58 after grinding is irradiated with the electron beam, the inside of the irradiation chamber 52 may be a nitrogen atmosphere. Further, the rubber roller 58 after grinding is allowed to rotate with a member for roller rotation 59 and moves from the left side to the right side in the irradiation chamber in FIG. 5 by conveying unit. It should be noted that the electron beam-generating portion 51 and the irradiation chamber 52 are surrounded by lead shielding (not shown) in order to prevent an X-ray to be generated secondarily upon irradiation with an electron beam from leaking to the outside.

The irradiation hole foil 57 is formed of a metal foil and separates a vacuum atmosphere in the electron beam-generating portion from an air atmosphere in the irradiation chamber. Further, an electron beam is extracted into the irradiation chamber via the irradiation hole foil 57. As mentioned above, when an electron beam is applied to the irradiation of the roller, the inside of the irradiation chamber 52 in which the roller is irradiated with an electron beam may be a nitrogen atmosphere. Accordingly, the irradiation hole foil 57 to be provided at the boundary between the electron beam-generating portion 51 and the irradiation chamber 52 desirably has no pinhole, has a mechanical strength enough to maintain a vacuum atmosphere in the electron beam-generating portion, and allows an electron beam to pass therethrough easily.

Therefore, the irradiation hole foil 57 is desirably a metal foil having a small specific gravity and a small thickness, and an aluminum or titanium foil is generally used. A hardening treatment condition with an electron beam depends on the accelerating voltage and dose of the electron beam. The accelerating voltage affects a hardening treatment depth (also referred to as hardening treatment thickness or thickness of a hardened region), and a condition for the accelerating voltage to be used in the present invention is preferably 40 kV or more and 300 kV or less in a low-energy region. When the accelerating voltage is 40 kV or more, a hardening treatment depth enough to provide the effect of the present invention can be easily obtained. Further, when the accelerating voltage is set to 300 kV or less, an increase in apparatus cost due to upsizing of an electron beam irradiation apparatus can be particularly suppressed. A more preferred condition for the accelerating voltage is 80 kV or more and 150 kV or less.

In the irradiation with an electron beam, the dose of the electron beam is defined by the following equation (1).

$$D=(K\cdot I)/V \tag{1}$$

In the equation, D represents a dose (kGy), K represents an apparatus constant, I represents an electron current (mA), and V represents a treatment speed (m/min). The apparatus constant K is a constant representing the efficiency of each apparatus and is an indicator of the performance of the apparatus. The apparatus constant K may be determined by measuring doses at different electron currents and treatment speeds under the condition of a constant accelerating voltage. The measurement of the dose of the electron beam may be carried out by attaching a film for dose measurement onto a roller surface, treating the resultant with an electron beam irradiation apparatus as a practical case, and measuring the film for dose measurement on the roller surface with a film dosimeter. In that case, a trade name: FWT-60 and a trade name: FWT-92D type (both manufactured by Far West Technology) may be used as the film for dose measurement and the film dosimeter, respectively.

The dose of the electron beam to be used in the present invention is preferably 30 kGy or more and 3,000 kGy or less. When the dose is 30 kGy or more, a surface hardness enough to provide the effect of the present invention can be easily obtained. Further, when the dose is 3,000 kGy or less, an increase in manufacturing cost due to upsizing of an electron beam irradiation apparatus or increasing in treatment time can be particularly suppressed. A more preferred condition for the dose of the electron beam is 200 kGy or more and 2,000 kGy or less.

In the present invention, the composite particles exposed on the surface of the elastic layer are supported by a region hardened with an electron beam.

FIGS. 3A and 3B are schematic diagrams illustrating surface profiles of the charging roller of the present invention. FIG. 3A illustrates a case where the hardened region has a large thickness, and FIG. 3B illustrates a case where the hardened region has a small thickness.

The thickness of the hardened region is not particularly defined, but is preferably 0.5 times or more the weight average particle diameter of the composite particles to be used and 200 μm or less.

When the thickness of the hardened region is set to 0.5 times or more the weight average particle diameter of the composite particles, the burying of the composite particles, which are exposed on the surface of the charging member, into the elastic layer at the nip with the photosensitive member can be suppressed more certainly.

Further, when the thickness of the hardened region is set to 200 μm or less, the width of the nip with the photosensitive member can be suppressed from becoming excessively narrow owing to an increase in internal hardness of the charging member.

As described above, the hardening treatment depth with an electron beam varies depending on the accelerating voltage. Further, in general, it is known that an electron beam penetration depth varies depending on the density of a substance to be irradiated. Therefore, as a method of confirming an actual hardening treatment depth, there may be given surface hardness measurement using a universal hardness meter.

A universal hardness is a physical property value determined as (Test load)/(Surface area of indenter under test load) ($N/mm^2$) by pressing an indenter into a measurement target under a load. The measurement of the universal hardness may be carried out, for example, through the use of a hardness measurement apparatus such as an ultra-micro hardness meter H-100 V (trade name) manufactured by Fischer. In this measurement apparatus, an indenter such as a quadrangular pyramid indenter is pressed into an object to be measured while a predetermined relatively small test load is applied, and at a time point when an indentation depth reaches a predetermined value, a surface area in contact with the indenter is determined based on the indentation depth. Then, a universal hardness is determined from the above-mentioned expression. That is, when the indenter is pressed into the object to be measured under a constant-load measurement condition, a stress at that time with respect to the indentation depth is defined as a universal hardness.

Figure 4:
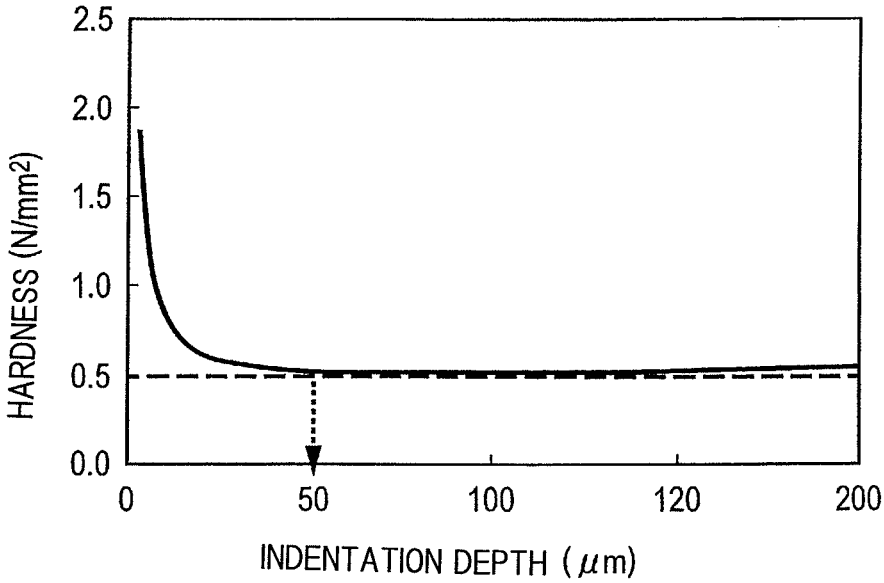
FIG. 4 is a graph showing an example of measurement results of a universal hardness.

FIG. 4 shows an example of the measurement results of the universal hardness. In the graph, the abscissa axis represents an indentation depth (μm) and the ordinate axis represents a hardness ($N/mm^2$). Based on FIG. 4, an abscissa axis value at the point where a difference occurs between a measurement curve and a straight line extrapolated from the measurement region of 150 μm or more and 200 μm or less in the abscissa axis as a linear region having a small change in hardness with respect to the indentation depth may be defined as the thickness of the hardened region 13. It should be noted that the thickness of the hardened region of the measurement example in FIG. 4 is 50 μm.

Further, the electron beam treatment is characterized in that a hardened region having a depth of, for example, 10 μm or more from a roller surface can be produced in an elastic layer of one layer as described above.

In the charging roller subjected to irradiation with an electron beam, in general, the inside of the elastic layer is soft, and a hardened region having a hardness gradient in a radial direction of the charging roller (specifically, the elastic layer is the hardest on the surface and becomes softer toward the inside of the elastic layer) is formed only in the surface of the elastic layer. When the charging roller is measured with a universal hardness meter, the measurement results as shown in FIG. 4 are obtained. That is, through the use of the universal hardness meter, it is possible to confirm that the elastic layer of the charging member has a hardened region formed by irradiation with an electron beam.

EXAMPLES

Hereinafter, the present invention is described in more detail by way of examples. However, the present invention is by no means limited to these examples. It should be noted that, in the following, a commercial high-purity product was used as a reagent or the like unless otherwise specified.

<Preparation of Composite Particle Nos. 1 to 4>

Composite particles including silica-containing porous particles whose surface was coated with a carbon-containing film according to the present invention were produced by the following method.

First, defatted rice bran passed through a 70-mesh sieve was prepared as a raw material. To the defatted rice bran was added a phenolic resin (trade name: GA-1364A, manufactured by DIC) at a ratio of 25 mass % with respect to the total mass of the raw material and the phenolic resin, followed by mixing.

After that, the mixture was heated to a temperature of 90° C., granulated, and passed through a 5-mesh sieve to obtain a particulate mixture.

The particulate mixture was calcined in a rotary tube furnace under nitrogen gas. It should be noted that the temperature was increased from room temperature (about 25° C.) to 500° C. at a rate of 1° C./min during the calcining. Then, the mixture was left to stand still at 500° C. for 1 hour. Next, the temperature was increased to 900° C. at a rate of 2° C./min. After that, the mixture was left to stand still at 900° C. for 2 hours and then cooled to room temperature to obtain a calcined product. In this case, the temperature was cooled from 900° C. to room temperature at a rate of 2° C./min.

The resultant calcined product was pulverized and classified through the use of a pulverizer equipped with airflow classification unit to obtain composite particles Nos. 1 to 4 having weight average particle diameters and pore diameters shown in Table 1 below.

TABLE 1

| Composite particle No. | Weight average particle diameter (μm) | Pore diameter (μm) |
|---|---|---|
| 1 | 5 | 1 |
| 2 | 70 | 8 |
| 3 | 103 | 10 |
| 4 | 1 | 0.5 |

Example 1

Materials shown in Table 2 below were mixed with a 6-L pressure kneader (trade name: TD6-15MDX, manufactured by TOHSHIN CO., LTD.) for 16 minutes at a filling factor of 70 vol % and a blade rotational frequency of 30 $min^{-1}$ (rpm). Thus, an A-kneading rubber composition was obtained.

TABLE 2

| Material | Compounding amount (part(s) by mass) |
|---|---|
| NBR as raw material rubber (trade name; JSR N230SV, manufactured by JSR) | 100 |
| Zinc stearate | 1 |
| Zinc oxide (Zinc White) | 5 |
| Calcium carbonate (trade name: NANOX #30, manufactured by MARUO CALCIUM CO., LTD.) | 20 |
| Carbon black (trade name: TOKABLACK #7360SB, manufactured by TOKAI CARBON CO., LTD.) | 48 |
| Composite particle No. 1 | 1 |

Next, materials shown in Table 3 below were mixed with the A-kneading rubber composition with an open roll having a roll diameter of 12 inches (0.30 m). At this time, the mixture was bilaterally cut a total of twenty times at a front roll rotational frequency of 8 rpm, a back roll rotational frequency of 10 rpm, and a roll interval of 2 mm, and then subjected to tight milling ten times at a roll interval of 0.5 mm. Thus, an unvulcanized rubber composition for an elastic layer was obtained.

TABLE 3

| Material | Compounding amount (parts by mass) |
|---|---|
| Sulfur | 1.2 |
| Tetrabenzylthiuram disulfide (trade name: PERKACIT-TBzTD (hereinafter, abbreviated as TBzTD), manufactured by FLEXSYS) | 4.5 |

(Molding of Vulcanized Rubber Layer)

An electro-conductive vulcanizing adhesive (trade name: METALOC U-20, manufactured by Toyo Kagaku Kenkyusho Co., Ltd.) was applied to a central portion having a length of 222 mm in the axial direction of the cylindrical surface of a cylindrical electro-conductive mandrel (made of steel and having a nickel-plated surface) having a diameter of 6 mm and a length of 244 mm, and was then dried at 80° C. for 30 minutes. Next, the unvulcanized rubber composition was simultaneously extruded, by extrusion molding using a cross head, into a cylindrical shape in a coaxial fashion around the mandrel at the center, to thereby produce a unvulcanized rubber roller having a diameter of 8.8 mm and coated with the unvulcanized rubber composition on the outer circumference of the mandrel.

In that case, an extruder having a cylinder diameter of 45 mm (Φ45) and an L/D of 20 was used as an extruder, and the temperatures of a head, a cylinder, and a screw were controlled to 90° C., 90° C., and 90° C., respectively during the extrusion. Both ends of the layer of the unvulcanized rubber composition in the unvulcanized rubber roller after molding were cut, and the width in an axial direction of the layer of the unvulcanized rubber composition was set to 226 mm.

After that, the resultant was heated in an electric furnace at 160° C. for 40 minutes to convert the layer of the unvulcanized rubber composition into a vulcanized rubber layer. Subsequently, a surface of the vulcanized rubber layer was ground with a grinder of a plunge cut grinding mode. Thus, a vulcanized rubber roller including the vulcanized rubber layer, on which part of the composite particles was exposed, having a crown shape with an end portion diameter of 8.35 mm and a central portion diameter of 8.50 mm was obtained.

(Surface Hardening Treatment of Vulcanized Rubber Layer after Grinding)

The surface of the resultant vulcanized rubber roller after grinding (vulcanized rubber layer surface) was subjected to a hardening treatment by irradiation with an electron beam to obtain a charging roller including an elastic layer having a hardened region in its surface. An electron beam irradiation apparatus having a maximum accelerating voltage of 150 kV and a maximum electron current of 40 mA (manufactured by IWASAKI ELECTRIC CO., LTD.) was used for the irradiation with an electron beam, and nitrogen gas was purged during the irradiation. Conditions for the treatment were as follows: accelerating voltage: 150 kV; electron current: 35 mA; treatment speed: 1 m/min; and oxygen concentration: 100 ppm. In this case, the apparatus constant of the electron beam irradiation apparatus at an accelerating voltage of 150 kV was 37.8, and the dose calculated from the equation (1) was 1,323 kGy.

(Measurement of Hardening Treatment Thickness)

A hardening treatment thickness was measured by measuring the surface hardness of a charging roller with a universal hardness meter. The measurement was carried out through the use of an ultra-micro hardness meter (trade name: H-100V, manufactured by Fischer), and a quadrangular pyramid diamond indenter was used as an indenter. An indentation speed satisfies the condition of the following equation (2).

$$dF/dt = 1{,}000 \text{ mN}/240 \text{ s} \quad (2)$$

(In the equation (2), F represents a force and t represents a time.)

As shown in FIG. 4, an abscissa axis value at the point where a difference occurred between a measurement curve and a straight line extrapolated from a measurement region of 150 μm or more and 200 μm or less in the abscissa axis having a small change in hardness with respect to an indentation depth was determined as the thickness of a hardened region. As a result, the thickness of the hardened region was 90 μm.

(Measurement of Surface Roughness)

The ten-point average roughness Rz of the surface of the charging roller (elastic layer) was measured. The measurement was carried out by a surface roughness-measuring apparatus (trade name: SURFCORDER SE3400, manufactured by Kosaka Laboratory Ltd.) in conformity with the Japanese Industrial Standards (JIS) B0601:1982. A contact needle made of diamond having a tip radius of 2 μm was used in the measurement. Conditions for the measurement were as follows.

Measuring speed: 0.5 mm/s
Cut-off frequency λc: 0.8 mm
Reference length: 0.8 mm
Evaluation length: 8.0 mm The measurement was carried out as follows: a roughness curve was measured for each of a total of six points including three points in an axial direction by two points in a circumferential direction per charging roller to calculate an Rz value; and an average value of the Rz values for the six points was determined and adopted as an Rz value for the charging roller. As a result, Rz was 5.4 μm.

(Image Evaluation)

A laser beam printer (trade name: LaserJet P1005 manufactured by Hewlett-Packard, for longitudinally outputting A4 paper, using an elastic blade as a cleaning member) was prepared as an electrophotographic apparatus to be used in evaluation. The charging roller produced in the foregoing was integrated into a process cartridge for the laser beam printer and mounted onto the laser beam printer. One sheet of a halftone image (image obtained by drawing lines with a width of one dot at an interval of two dots in a direction perpendicular to a rotational direction of an electrophotographic photosensitive member) was output under the environment of a temperature of 23° C. and a relative humidity of 50%. This is referred to as initial halftone image.

Next, an endurance test was carried out as follows: 2,000 sheets of electrophotographic images were output through the repetition of an intermittent image forming operation involving outputting one sheet of an electrophotographic image, then completely stopping the rotation of an electrophotographic photosensitive member, and restarting an image forming operation again. The images output at this time are ruled line-like images in which a margin of 118 dots is repeated after a horizontal line of 2 dots. Next, one sheet of a halftone image was output again. This is referred to as halftone image after the endurance test. Then, the resultant two sheets of the halftone images were visually observed for the presence or absence of density unevenness due to charging unevenness and the degree thereof and evaluated based on the following criteria.

(Evaluation 1) Evaluation of Charging Performance (at Initial Stage and after Endurance)

Each of the halftone images at the initial stage and after the endurance test obtained in the foregoing was visually observed, and the presence or absence of density unevenness due to charging unevenness was evaluated based on the criteria described in Table 4 below. This allows the charging performance of the charging roller according to this example at the initial stage and after the endurance test to be grasped.

TABLE 4

| Rank | Evaluation criteria |
|---|---|
| A | No density unevenness due to charging unevenness is observed in a halftone image. |
| B | Charging unevenness is observed in a halftone image. |

(Evaluation 2) Evaluation of Presence or Absence of Image Defects Due to Cleaning Failure 2,000 sheets of the electrophotographic images output in the endurance test were divided into two groups, i.e., a first group (the first sheet to the 1,000-th sheet) and a second group (the 1,001-st sheet to the 2,000-th sheet). 1,000 sheets of the electrophotographic images belonging to each of the groups were visually observed for the presence or absence of an image defect due to a cleaning failure of a photosensitive member and the degree thereof and evaluated based on the criteria described in Table 5 below.

TABLE 5

| Rank | Evaluation criteria |
|---|---|
| A | No print having an image defect due to a cleaning failure is observed. |
| B | The number of prints having an extremely slight image defect due to a cleaning failure is 1 or more and less than 100. |
| C | The number of prints having a clear image defect due to a cleaning failure is 1 or more and less than 100. |
| D | The number of prints having a clear image defect due to a cleaning failure is 100 or more. |

Example 2

A charging roller including an elastic layer having a hardened region in its surface was produced in the same manner as in Example 1 except that the number of compounding parts of the composite particles used in the A-kneading rubber composition of Example 1 was changed to 5 parts by mass. The measurement of a hardening treatment thickness and a surface roughness and the evaluation of images were carried out in the same manner as in Example 1.

Example 3

A charging roller including an elastic layer having a hardened region in its surface was produced in the same manner as in Example 1 except that the number of compounding parts of the composite particles used in the A-kneading rubber composition of Example 1 was changed to 30 parts by mass. The measurement of a hardening treatment thickness and a surface roughness and the evaluation of images were carried out in the same manner as in Example 1.

Example 4

A charging roller including an elastic layer having a hardened region in its surface was produced in the same manner as in Example 1 except that the weight average particle diameter of the composite particles used in the A-kneading rubber composition of Example 1 was changed to 70 μm. The measurement of a hardening treatment thickness and a surface roughness and the evaluation of images were carried out in the same manner as in Example 1.

Example 5

A charging roller including an elastic layer having a hardened region in its surface was produced in the same manner as in Example 4 except that the number of compounding parts of the composite particles used in the A-kneading rubber composition of Example 4 was changed to 5 parts by mass. The measurement of a hardening treatment thickness and a surface roughness and the evaluation of images were carried out in the same manner as in Example 1.

Example 6

A charging roller including an elastic layer having a hardened region in its surface was produced in the same manner as in Example 4 except that the number of compounding parts of the composite particles used in the A-kneading rubber composition of Example 4 was changed to 30 parts by mass. The measurement of a hardening treatment thickness and a surface roughness and the evaluation of images were carried out in the same manner as in Example 1.

Example 7

A charging roller including an elastic layer having a hardened region in its surface was produced in the same manner as in Example 1 except that the weight average particle diameter of the composite particles used in the A-kneading rubber composition of Example 1 was changed to 103 μm. The measurement of a hardening treatment thickness and a surface roughness and the evaluation of images were carried out in the same manner as in Example 1.

Example 8

A charging roller including an elastic layer having a hardened region in its surface was produced in the same manner as in Example 7 except that the number of compounding parts of the composite particles used in the A-kneading rubber composition of Example 7 was changed to 30 parts by mass. The measurement of a hardening treatment thickness and a surface roughness and the evaluation of images were carried out in the same manner as in Example 1.

Example 9

A charging roller including an elastic layer having a hardened region in its surface was produced in the same manner as in Example 1 except that NBR (trade name: JSR N230SV, manufactured by JSR) as the raw material rubber in Example 1 was changed to SBR (trade name: Nipol1507, manufactured by ZEON CORPORATION). The measurement of a hardening treatment thickness and a surface roughness and the evaluation of images were carried out in the same manner as in Example 1.

Example 10

A charging roller including an elastic layer having a hardened region in its surface was produced in the same manner as in Example 9 except that the number of compounding parts of the composite particles used in the A-kneading rubber composition of Example 9 was changed to 5 parts by mass. The measurement of a hardening treatment thickness and a surface roughness and the evaluation of images were carried out in the same manner as in Example 1.

Example 11

A charging roller including an elastic layer having a hardened region in its surface was produced in the same manner as in Example 9 except that the number of compounding parts of the composite particles used in the A-kneading rubber composition of Example 9 was changed to 30 parts by mass. The measurement of a hardening treatment thickness and a surface roughness and the evaluation of images were carried out in the same manner as in Example 1.

Example 12

A charging roller including an elastic layer having a hardened region in its surface was produced in the same manner as in Example 9 except that the weight average particle diameter of the composite particles used in the A-kneading rubber composition of Example 9 was changed to 70 μm. The measurement of a hardening treatment thickness and a surface roughness and the evaluation of images were carried out in the same manner as in Example 1.

Example 13

A charging roller including an elastic layer having a hardened region in its surface was produced in the same manner as in Example 12 except that the number of compounding parts of the composite particles used in the A-kneading rubber composition of Example 12 was changed to 5 parts by mass. The measurement of a hardening treatment thickness and a surface roughness and the evaluation of images were carried out in the same manner as in Example 1.

Example 14

A charging roller including an elastic layer having a hardened region in its surface was produced in the same manner as in Example 12 except that the number of compounding parts of the composite particles used in the A-kneading rubber composition of Example 12 was changed to 30 parts by mass. The measurement of a hardening treatment thickness and a surface roughness and the evaluation of images were carried out in the same manner as in Example 1.

Example 15

A charging roller including an elastic layer having a hardened region in its surface was produced in the same manner as in Example 1 except that: NBR (trade name: JSR N230SV, manufactured by JSR) as the raw material rubber used in the A-kneading rubber composition of Example 1 was changed to BR (trade name: BR-1220L, manufactured by ZEON CORPORATION); and the materials to be mixed with the A-kneading rubber composition in obtaining the unvulcanized rubber composition were changed to materials shown in Table below. The measurement of a hardening treatment thickness and a surface roughness and the evaluation of images were carried out in the same manner as in Example 1.

TABLE 6

| Material | Compounding amount (part(s) by mass) |
|---|---|
| Sulfur | 1.2 |
| TBzTD | 1.0 |
| N-t-Butyl-2-benzothiazole sulfenimide (trade name: SANTOCURE-TBSI (hereinafter, abbreviated as TBSI) manufactured by FLEXSYS) | 1.0 |

Example 16

A charging roller including an elastic layer having a hardened region in its surface was produced in the same manner as in Example 15 except that the number of compounding parts of the composite particles used in the A-kneading rubber composition of Example 15 was changed to 5 parts by mass. The measurement of a hardening treatment thickness and a surface roughness and the evaluation of images were carried out in the same manner as in Example 1.

Example 17

A charging roller including an elastic layer having a hardened region in its surface was produced in the same manner as in Example 15 except that the weight average particle diameter of the composite particles used in the A-kneading rubber composition of Example 15 was changed to 70 μm. The measurement of a hardening treatment thickness and a surface roughness and the evaluation of images were carried out in the same manner as in Example 1.

Example 18

A charging roller including an elastic layer having a hardened region in its surface was produced in the same manner as in Example 17 except that the number of compounding parts of the composite particles used in the A-kneading rubber composition of Example 17 was changed to 5 parts by mass. The measurement of a hardening treatment thickness and a surface roughness and the evaluation of images were carried out in the same manner as in Example 1.

Example 19

A charging roller including an elastic layer having a hardened region in its surface was produced in the same manner as in Example 1 except that: NBR (trade name: JSR N230SV, manufactured by JSR) as the raw material rubber used in the A-kneading rubber composition of Example 1 was changed to EPDM (trade name: EP33, manufactured by JSR); and the materials to be mixed with the A-kneading rubber composition in obtaining the unvulcanized rubber composition were changed to materials shown in Table 6. The measurement of a hardening treatment thickness and a surface roughness and the evaluation of images were carried out in the same manner as in Example 1.

Example 20

A charging roller including an elastic layer having a hardened region in its surface was produced in the same manner as in Example 19 except that the number of compounding parts of the composite particles used in the A-kneading rubber composition of Example 19 was changed to 5 parts by mass. The measurement of a hardening treatment thickness and a surface roughness and the evaluation of images were carried out in the same manner as in Example 1.

Example 21

A charging roller including an elastic layer having a hardened region in its surface was produced in the same manner as in Example 19 except that the weight average particle diameter of the composite particles used in the A-kneading rubber composition of Example 19 was changed to 70 μm. The measurement of a hardening treatment thickness and a surface roughness and the evaluation of images were carried out in the same manner as in Example 1.

Example 22

A charging roller including an elastic layer having a hardened region in its surface was produced in the same manner as in Example 21 except that the number of compounding parts of the composite particles used in the A-kneading rubber composition of Example 21 was changed to 5 parts by mass. The measurement of a hardening treatment thickness and a surface roughness and the evaluation of images were carried out in the same manner as in Example 1.

Example 23

A charging roller including an elastic layer having a hardened region in its surface was produced in the same manner as in Example 1 except that the weight average particle diameter of the composite particles used in the A-kneading rubber composition of Example 1 was changed to 1 μm. The measurement of a hardening treatment thickness and a surface roughness and the evaluation of images were carried out in the same manner as in Example 1.

Example 24

A charging roller including an elastic layer having a hardened region in its surface was produced in the same manner as in Example 23 except that the number of compounding parts of the composite particles used in the A-kneading rubber composition of Example 23 was changed to 30 parts by mass. The measurement of a hardening treatment thickness and a surface roughness and the evaluation of images were carried out in the same manner as in Example 1.

Example 25

A charging roller including an elastic layer having a hardened region in its surface was produced in the same manner as in Example 1 except that the number of compounding parts of the composite particles used in the A-kneading rubber composition of Example 1 was changed to 0.5 part by mass. The measurement of a hardening treatment thickness and a surface roughness and the evaluation of images were carried out in the same manner as in Example 1.

Example 26

A charging roller was produced in exactly the same manner as in Example 4 except that the conditions for the irradiation with an electron beam in Example 4 were changed as follows: accelerating voltage: 80 kV; electron current: 35 mA; treatment speed: 1 m/min; and oxygen concentration: 100 ppm. In this case, the apparatus constant of the electron beam irradiation apparatus at an accelerating voltage of 80 kV was 20.4, and the dose calculated from the equation (1) was 714 kGy. The measurement of a hardening treatment thickness and a surface roughness and the evaluation of images were carried out in the same manner as in Example 1.

Example 27

A charging roller was produced in exactly the same manner as in Example 4 except that the conditions for the irradiation with an electron beam in Example 4 were changed as follows: accelerating voltage: 70 kV; electron current: 35 mA; treatment speed: 1 m/min; and oxygen concentration: 100 ppm. In this case, the apparatus constant of the electron beam irradiation apparatus at an accelerating voltage of 70 kV was 17.9, and the dose calculated from the equation (1) was 626.5 kGy. The measurement of a hardening treatment thickness and a surface roughness and the evaluation of images were carried out in the same manner as in Example 1.

Comparative Example 1

A charging roller including an elastic layer having a hardened region in its surface was produced in the same manner as in Example 1 except that no composite particle was added to the A-kneading rubber composition of Example 1. The measurement of a hardening treatment thickness and a surface roughness and the evaluation of images were carried out in the same manner as in Example 1.

Comparative Example 2

A charging roller including an elastic layer having a hardened region in its surface was produced in the same manner as in Example 1 except that the composite particles used in the A-kneading rubber composition of Example 1 were changed to 20 parts by mass of amorphous silica particles (trade name: BY-001, manufactured by TOSOH SILICA CORPORATION, average particle diameter: 13.3 μm). The measurement of a hardening treatment thickness and a surface roughness and the evaluation of images were carried out in the same manner as in Example 1.

Comparative Example 3

A charging roller was produced in the same manner as in Example 1 except that the vulcanized rubber roller surface after grinding was not subjected to irradiation with an electron beam in Example 1. The measurement of a surface roughness and the evaluation of images were carried out in the same manner as in Example 1. It should be noted that a hardening treatment thickness was not measured because the irradiation with an electron beam was not carried out.

The compositions of Examples and Comparative Examples described above are summarized in Table 6-1 to Table 6-4. Further, Tables 7-1 to 7-4 show the evaluation results of the charging rollers according to Examples and Comparative Examples.

In Examples in which a roller surface was roughened by the composite particles including silica-containing porous particles whose surface was coated with a carbon-containing film and hardened by irradiation with an electron beam, an improvement in cleaning failure is observed as compared to Comparative Examples. Comparative Example 1 is a case where the composite particles were not included. Comparative Example 2 is an example in which amorphous silica particles were added in place of the composite particles. Comparative Example 3 is an example in which there is no hardened region formed by irradiation with an electron beam. In any of Comparative Examples, the rank of the cleaning failure is low. Thus, the effect of the system used in Examples can be confirmed.

On the other hand, Examples 1 to 27 are the charging rollers of the present invention and provide satisfactory images causing no problem in practical use in terms of both of charging evenness after endurance and a cleaning failure image rank (rank C or higher).

TABLE 6-1

| Example | NBR (part (s) by mass) | SBR (part (s) by mass) | Zinc stearate (part (s) by mass) | Zinc oxide (part (s) by mass) | Calcium carbonate (part (s) by mass) | Carbon black (part (s) by mass) | TBzTD (part (s) by mass) | Sulfur (part (s) by mass) | Composite particle No. | Composite particle Compounding amount (part (s) by mass) |
|---|---|---|---|---|---|---|---|---|---|---|
| 1 | 100 | — | 1 | 5 | 20 | 48 | 4.5 | 1.2 | 1 | 1 |
| 2 | 100 | — | 1 | 5 | 20 | 48 | 4.5 | 1.2 | 1 | 5 |
| 3 | 100 | — | 1 | 5 | 20 | 48 | 4.5 | 1.2 | 1 | 30 |
| 4 | 100 | — | 1 | 5 | 20 | 48 | 4.5 | 1.2 | 2 | 1 |
| 5 | 100 | — | 1 | 5 | 20 | 48 | 4.5 | 1.2 | 2 | 5 |
| 6 | 100 | — | 1 | 5 | 20 | 48 | 4.5 | 1.2 | 2 | 30 |
| 7 | 100 | — | 1 | 5 | 20 | 48 | 4.5 | 1.2 | 3 | 1 |
| 8 | 100 | — | 1 | 5 | 20 | 48 | 4.5 | 1.2 | 3 | 30 |
| 9 | — | 100 | 1 | 5 | 20 | 48 | 4.5 | 1.2 | 1 | 1 |
| 10 | — | 100 | 1 | 5 | 20 | 48 | 4.5 | 1.2 | 1 | 5 |

TABLE 6-2

| Example | NBR (part (s) by mass) | SBR (part (s) by mass) | EPDM (part (s) by mass) | Zinc stearate (part (s) by mass) | Zinc oxide (part (s) by mass) | Calcium carbonate (part (s) by mass) | Carbon black (part (s) by mass) | TBzTD (part (s) by mass) | TBSI (part (s) by mass) | Sulfur (part (s) by mass) | Composite particle No. | Composite particle Compounding amount (part (s) by mass) |
|---|---|---|---|---|---|---|---|---|---|---|---|---|
| 11 | 100 | — | — | 1 | 5 | 20 | 48 | 4.5 | — | 1.2 | 1 | 30 |
| 12 | 100 | — | — | 1 | 5 | 20 | 48 | 4.5 | — | 1.2 | 2 | 1 |
| 13 | 100 | — | — | 1 | 5 | 20 | 48 | 4.5 | — | 1.2 | 2 | 5 |
| 14 | 100 | — | — | 1 | 5 | 20 | 48 | 4.5 | — | 1.2 | 2 | 30 |
| 15 | — | 100 | — | 1 | 5 | 20 | 48 | 1 | 1 | 1.2 | 1 | 1 |
| 16 | — | 100 | — | 1 | 5 | 20 | 48 | 1 | 1 | 1.2 | 1 | 5 |
| 17 | — | 100 | — | 1 | 5 | 20 | 48 | 1 | 1 | 1.2 | 2 | 1 |
| 18 | — | 100 | — | 1 | 5 | 20 | 48 | 1 | 1 | 1.2 | 2 | 5 |
| 19 | — | — | 100 | 1 | 5 | 20 | 48 | 1 | 1 | 1.2 | 1 | 1 |
| 20 | — | — | 100 | 1 | 5 | 20 | 48 | 1 | 1 | 1.2 | 1 | 5 |

TABLE 6-3

| Example | NBR (part (s) by mass) | EPDM (part (s) by mass) | Zinc stearate (part (s) by mass) | Zinc oxide (part (s) by mass) | Calcium carbonate (part (s) by mass) | Carbon black (part (s) by mass) | TBzTD (part (s) by mass) | TBSI (part (s) by mass) | Sulfur (part (s) by mass) | Composite particle No. | Composite particle Compounding amount (part (s) by mass) |
|---|---|---|---|---|---|---|---|---|---|---|---|
| 21 | — | 100 | 1 | 5 | 20 | 48 | 1 | 1 | 1.2 | 2 | 1 |
| 22 | — | 100 | 1 | 5 | 20 | 48 | 1 | 1 | 1.2 | 2 | 5 |
| 23 | 100 | — | 1 | 5 | 20 | 48 | 4.5 | — | 1.2 | 4 | 1 |
| 24 | 100 | — | 1 | 5 | 20 | 48 | 4.5 | — | 1.2 | 4 | 30 |
| 25 | 100 | — | 1 | 5 | 20 | 48 | 4.5 | — | 1.2 | 1 | 0.5 |
| 26 | 100 | — | 1 | 5 | 20 | 48 | 4.5 | — | 1.2 | 2 | 1 |
| 27 | 100 | — | 1 | 5 | 20 | 48 | 4.5 | — | 1.2 | 2 | 1 |

TABLE 6-4

| Comparative Example | NBR (part (s) by mass) | Zinc stearate (part (s) by mass) | Zinc oxide (part (s) by mass) | Calcium carbonate (part (s) by mass) | Carbon black (part (s) by mass) | TBzTD (part (s) by mass) | Sulfur (part (s) by mass) | Composite particle No. | Composite particle Compounding amount (part (s) by mass) | Silica particle (part (s) by mass) |
|---|---|---|---|---|---|---|---|---|---|---|
| 1 | 100 | 1 | 5 | 20 | 48 | 4.5 | 1.2 | — | — | — |
| 2 | 100 | 1 | 5 | 20 | 48 | 4.5 | 1.2 | — | — | 20 |
| 3 | 100 | 1 | 5 | 20 | 48 | 4.5 | 1.2 | 1 | 1 | — |

TABLE 7-1

| Example | Accelerating voltage (kV) | Irradiation current amount | Dose (kGy) | Surface roughness (μm) | Hardening treatment thickness (μm) |
|---|---|---|---|---|---|
| 1 | 150 | 35 | 1,323 | 5.4 | 90 |
| 2 | 150 | 35 | 1,323 | 7.9 | 90 |
| 3 | 150 | 35 | 1,323 | 8.4 | 90 |
| 4 | 150 | 35 | 1,323 | 8.2 | 90 |
| 5 | 150 | 35 | 1,323 | 9.2 | 90 |
| 6 | 150 | 35 | 1,323 | 10.5 | 90 |
| 7 | 150 | 35 | 1,323 | 10.3 | 90 |
| 8 | 150 | 35 | 1,323 | 14.3 | 90 |
| 9 | 150 | 35 | 1,323 | 5.1 | 90 |
| 10 | 150 | 35 | 1,323 | 7.8 | 90 |
| 11 | 150 | 35 | 1,323 | 8.0 | 90 |
| 12 | 150 | 35 | 1,323 | 7.9 | 90 |
| 13 | 150 | 35 | 1,323 | 9.3 | 90 |
| 14 | 150 | 35 | 1,323 | 9.9 | 90 |
| 15 | 150 | 35 | 1,323 | 6.2 | 90 |
| 16 | 150 | 35 | 1,323 | 8.7 | 90 |
| 17 | 150 | 35 | 1,323 | 9.2 | 90 |
| 18 | 150 | 35 | 1,323 | 9.7 | 90 |
| 19 | 150 | 35 | 1,323 | 5.7 | 90 |
| 20 | 150 | 35 | 1,323 | 7.5 | 90 |
| 21 | 150 | 35 | 1,323 | 7.7 | 90 |
| 22 | 150 | 35 | 1,323 | 8.6 | 90 |
| 23 | 150 | 35 | 1,323 | 4.5 | 90 |
| 24 | 150 | 35 | 1,323 | 5.0 | 90 |
| 25 | 150 | 35 | 1,323 | 4.5 | 90 |
| 26 | 80 | 35 | 714 | 8.1 | 40 |
| 27 | 70 | 35 | 626.5 | 8.0 | 30 |

TABLE 7-2

| Comparative Example | Accelerating voltage (kV) | Irradiation current amount | Dose (kGy) | Surface roughness (μm) | Hardening treatment thickness (μm) |
|---|---|---|---|---|---|
| 1 | 150 | 35 | 1,323 | 3.5 | 90 |
| 2 | 150 | 35 | 1,323 | 4.9 | 90 |
| 3 | | Unirradiated | | 7.8 | — |

TABLE 7-3

| | Evaluation (1) | | Evaluation (2) | |
|---|---|---|---|---|
| Example | Initial stage | After endurance | First group | Second group |
| 1 | A | A | A | A |
| 2 | A | A | A | A |
| 3 | A | B | A | B |
| 4 | A | A | A | A |
| 5 | A | A | A | A |
| 6 | A | B | A | B |
| 7 | A | B | A | C |
| 8 | A | B | A | C |
| 9 | A | A | A | B |
| 10 | A | A | A | B |
| 11 | A | B | A | C |
| 12 | A | A | A | B |
| 13 | A | A | A | B |
| 14 | A | B | A | C |
| 15 | A | A | A | B |
| 16 | A | A | A | B |
| 17 | A | A | A | B |
| 18 | A | A | A | B |
| 19 | A | A | A | B |
| 20 | A | A | A | B |
| 21 | A | A | A | B |
| 22 | A | A | A | B |
| 23 | A | A | B | C |
| 24 | A | A | B | C |

TABLE 7-3-continued

| | Evaluation (1) | | Evaluation (2) | |
|---|---|---|---|---|
| Example | Initial stage | After endurance | First group | Second group |
| 25 | A | A | B | C |
| 26 | A | A | A | A |
| 27 | A | A | A | B |

TABLE 7-4

| | Evaluation (1) | | Evaluation (2) | |
|---|---|---|---|---|
| Comparative Example | Initial stage | After endurance | First group | Second group |
| 1 | A | B | D | D |
| 2 | A | B | D | D |
| 3 | A | B | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-146210, filed Jun. 30, 2011, which is hereby incorporated by reference herein in its entirety.

What is claimed is:

1. A charging member, comprising:

an electro-conductive support; and an elastic layer as a surface layer, wherein:

said elastic layer has a hardened region formed by irradiation with an electron beam; and said hardened region supports a composite particle in a state in which said composite particle is exposed on the surface of the elastic layer, thereby roughening the surface of the elastic layer, and wherein:

said composite particle includes a silica-containing porous particle whose surface is coated with a carbon-containing film.

2. The charging member according to claim 1, wherein a content of silica in said silica-containing porous particle is 80 mass % or more.

3. The charging member according to claim 1, wherein said silica-containing porous particle is composed only of silica.

4. The charging member according to claim 1, wherein a content of a carbon atom in said carbon-containing film is 50 mass % or more.

5. The charging member according to claim 1, wherein said carbon-containing film is composed only of carbon atom.

6. The charging member according to claim 1, wherein a thickness of said carbon-containing film is 50 nm or more and 10 μm or less.

7. The charging member according to claim 1, wherein a weight average particle diameter of said composite particle is 5 μm or more and 70 μm or less.

8. The charging member according to claim 1, wherein a pore diameter of said composite particles is 1 μm or more and 20 μm or less.

9. The charging member according to claim 1, wherein said elastic layer includes a thermosetting rubber or a thermoplastic elastomer.

10. The charging member according to claim 1, wherein a thickness of said hardened region is 0.5 times or more of the weight average particle diameter of said composite particle, and 200 μm or less.

11. An electrophotographic apparatus, comprising:

the charging member according to claim 1; and a photosensitive member.

12. A manufacturing method for a charging member, said charging member comprising an electro-conductive support, and an elastic layer as a surface layer, said the elastic layer having a hardened region formed by irradiation with an electron beam, said hardened region supporting a composite particle in a state in which said composite particle is exposed on the surface of the elastic layer, thereby roughening the surface of the elastic layer, and said composite particle including a silica-containing porous particle whose surface is coated with a carbon-containing film, the method comprising the steps of:

(1) forming a rubber layer containing said composite particle on the support;

(2) grinding a surface of the rubber layer to expose part of said composite particle; and (3) hardening the surface of the rubber layer to form the elastic layer by subjecting the surface of the rubber layer, on which the part of said composite particle is exposed, obtained in the step (2) to irradiation with the electron beam.

13. The manufacturing method for the charging member according to claim 12, wherein an accelerating voltage of the electron beam in the step (3) is 40 kV or more and 300 kV or less.

14. The manufacturing method for the charging member according to claim 12, wherein a dose of the electron beam in the step (3) is 30 kGy or more and 3,000 kGy or less.

* * * * *